US005765546A

United States Patent [19]

Mandeville et al.

[11] Patent Number: 5,765,546

[45] Date of Patent: Jun. 16, 1998

[54] DIRECT CONTACT WATER HEATER WITH DUAL WATER HEATING CHAMBERS

[75] Inventors: Luc Mandeville, Terrebonne; Stéphane Brunet, St-Laurent; Michel Dallaire, St-Bruno-de-Montarville; Pascal Bocherel, Ville Mont-Royal, all of Canada

[73] Assignees: Sofame; Sociéte en Commandite Gaz Metropolitain, both of Mtl, Canada; Gaz de France, La Plaine St-Denis, France

[21] Appl. No.: 655,609

[22] Filed: May 30, 1996

[51] Int. Cl.[6] ..... F24H 1/10

[52] U.S. Cl. ..... 126/355; 126/359; 122/31.1

[58] Field of Search ..... 126/355, 359, 126/360 R, 361, 368, 360 A; 122/20 A, 31.1, 31.2; 237/61, 8 A

[56] References Cited

U.S. PATENT DOCUMENTS

| | | | |
|---|---|---|---|
| 1,527,740 | 2/1925 | Lipshitz | 126/359 |
| 3,204,629 | 9/1965 | Newton, Jr. | 126/355 |
| 3,386,436 | 6/1968 | Miyahara | 126/355 |
| 4,753,220 | 6/1988 | Lutzen | 126/359 |
| 5,086,731 | 2/1992 | Lockett | 126/359 |
| 5,293,861 | 3/1994 | Mandeville et al. | 126/355 |
| 5,305,735 | 4/1994 | Welden | 126/359 |

*Primary Examiner*—James C. Yeung

[57] ABSTRACT

A dual direct contact water heater is described and consists of a heater housing having two sections, each section having a water reservoir. One section provides hot water at a high temperature and provides a source of heat exchange to heat an external source of water for commercial use. A burner is provided in the first section to provide the heat source to a packing through which water percolates. The source of water for the first section is the outlet of a heat exchanger whereby water from the reservoir is recirculated in a closed circuit in the first section. Hot gases rising from the first section is directed to a second section which also includes a second packing and a reservoir and it also has a closed loop whereby a second source of hot water, at a lower temperature, is utilized in a closed loop and in heat exchange with a second external source to produce domestic hot water or without heat exchanger to produce hot water for various processes. The fumes at the exhaust port of the second section are cooled considerably whereby the total efficiency of the water heater is greatly increased.

7 Claims, 3 Drawing Sheets

T < 100°F
16
12
11
13
28
15
27
25
21
22
20
23
19
11'
170°F
29
47
26
24
17
17'
10
SECTION B
14
18
SECTION A
H2O CITY SUPPLY
26'
25'
60°F
25"
36
36"
36'
140°F
50°F
38
37
39
165°F
33
31
35
185°F
42
34
30'
41
32
30

DIRECT CONTACT WATER HEATER WITH DUAL WATER HEATING CHAMBERS

TECHNICAL FIELD

The present invention relates to a direct contact water heater and more particularly to a dual section water heater having two sources of hot water, a first high temperature water source and a second hot water source at a lower temperature. The water in the reservoir is heated by a single or multiple burner or a single heat source (ex. flue gases) and recirculated in a closed loop with or without an associated external heat exchange device thereby achieving increased efficiency as a function of the temperature of the water recirculated to injection devices which re-injects the cooled hot water in the two sections of the heater for reheating and to cool the rising hot gases generated by the burner or/and entering the unit.

BACKGROUND ART

Direct contact water heaters are known using two sections of packings whereby to heat water by using two difference sources of heat, and namely the burner associated with the water heater and mounted at the bottom of the housing and an external source of hot gases being recovered from external devices. Such a burner construction is, for example, described in U.S. Pat. No. 5,293,861. However, it has been found that the efficiency of such direct contact water heaters drops off drastically once the temperature of the inlet water which is usually released through a spray nozzle at the top of the housing increases above 60° C. This therefore provides a restriction on the use of direct contact water heaters for providing a very hot water source in an efficient manner.

SUMMARY OF INVENTION

It is a feature of the present invention to provide a direct contact water heater incorporating dual hot water reservoir sections, with the water in said reservoirs being heated by a single or multiple burners and/or external heat sources (ex. hot flue gases from other devices).

Another feature of the present invention is to provide a direct contact water heater having dual hot water reservoir sections with the water therein being at different water temperatures and wherein each section is positioned side-by-side to provide a compact water heater housing.

Another feature of the present invention is to provide a direct contact water heater having dual hot water reservoir sections stacked vertically one on top of the other and providing efficient cooling of the flue gases rising through the sections prior to exiting from a top end of the housing.

Another feature of the present invention is to provide a direct contact water heater having dual hot water reservoir sections and utilizing an immerse burner housing which is used as the single heating source to heat the water percolating through the packings associated with each section of the water heater.

Another feature of the present invention is to provide a direct contact water heater with dual hot water reservoir sections and incorporating a second source of hot gases taken from an external system and connected to either the first or second section of the water heater.

Another feature of the present invention is to provide a direct contact water heater having dual hot water reservoir sections which provide two hot water sources at differing temperatures and wherein the efficiency of the heater is greatly increased as a function of the temperature of the inlet water supply to the sections which is connected in a closed loop or open loop with external heat exchange devices.

According to the above features, from a broad aspect, the present invention provides a direct contact water heater which comprises a housing having a first water spray nozzle positioned therein for spraying water to be heated downwardly on a first packing of heat exchange bodies held in a region of the housing by support means. An exhaust gas flue communicates with a top portion of the housing. A burner is connected to a bottom portion of the housing and disposed to heat water in a first water reservoir contained within the housing. A second packing of heat exchange bodies is held spaced above the first water reservoir by further support means. A second water spray nozzle is provided in the housing above the second packing for spraying water downwardly on the second packing. An intermediate hot water reservoir is defined in the housing in a space below the first packing. Passage means is provided for the passage of hot gases passing through the second packing to direct it to a space above the intermediate reservoir. Pump means is associated with a respective one of the first and second water reservoirs to circulate hot water therefrom to respective external heat exchange devices, connected respectively in a closed circuit, and using the single burner.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
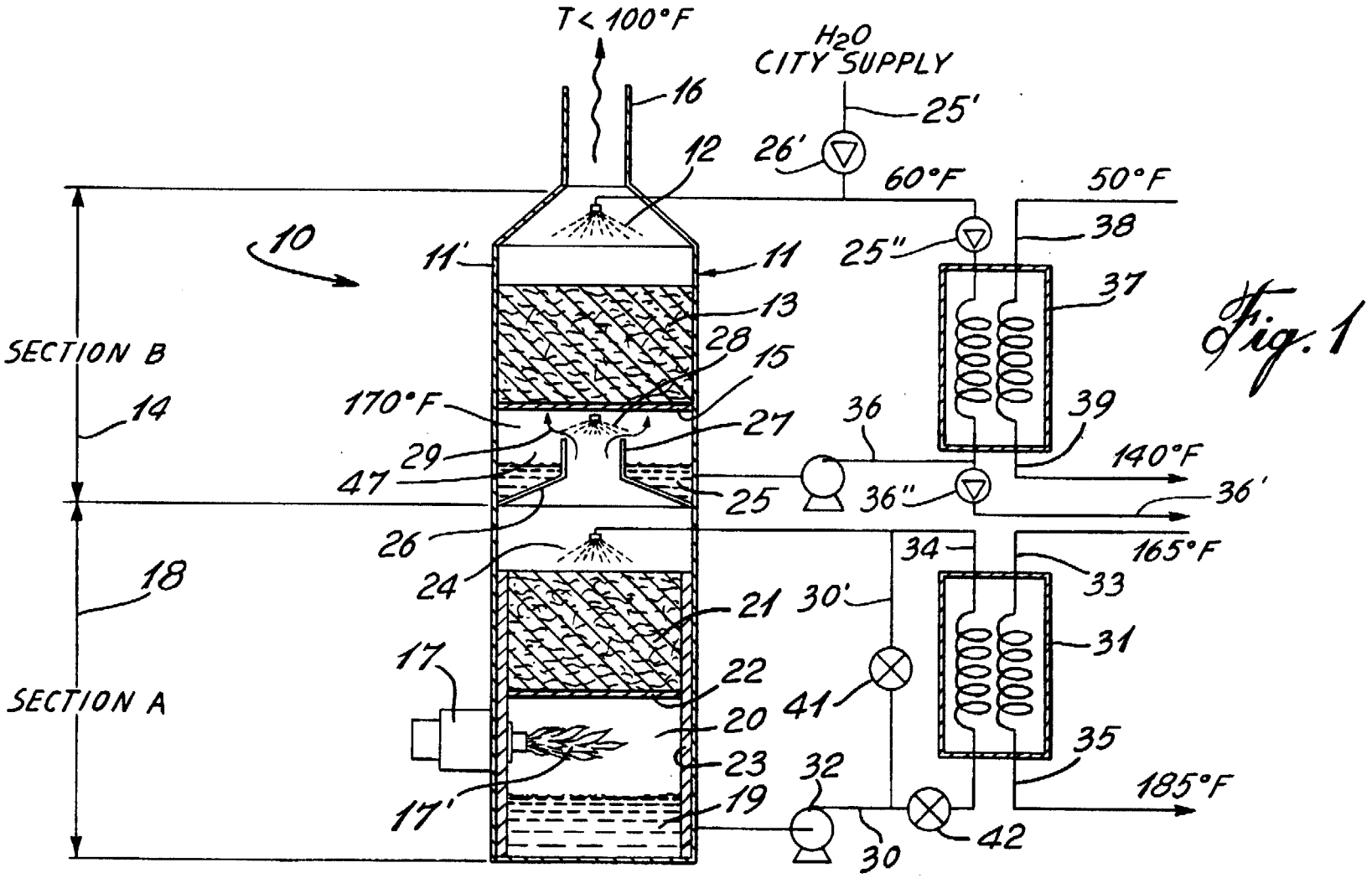
FIG. 1 is a simplified schematic diagram showing a direct contact water heater with dual water heating sections and dual water reservoirs and each having closed loop recirculating circuits associated with a respective heat exchanger, each section of the water heater being disposed one on top of the other in an elongated cylindrical vertical housing.

Referring to the drawings, and more particularly to FIG. 1, there is shown generally at 10 the dual section direct contact water heater of the present invention. The water heater 10 comprises a housing 11 having a first water spray nozzle 12 positioned above a first packing 13 of heat exchange bodies, not shown but obvious to a person skilled in the art, held in a top or second section B, denoted by reference numeral 14, of the housing. The packing 13 is held in that section at a predetermined location by support means 15, such as a suitable grating secured across the inner surface of the circumferential sidewall 11' of the housing.

An exhaust gas flue 16 is located at a top end of the top section B of the housing to release the cooled hot gases generated by the burner 17 which is located in the lower section A, depicted by reference numeral 18, and constituting the higher temperature section of the water heater. As hereinshown, the burner 17 is connected to the housing sidewall 11' and disposed to heat water in the water reservoir 19 of the bottom section A of the housing 11. The burner 17 generates a flame 17' in the area 20 of the lower section 18 above the reservoir 19. The burner 17 as hereinshown is a natural gas burner and capable of heating water percolating in the lower section to the reservoir 19 and at temperatures sufficient for use in heating systems of large buildings such as hotels, hospitals, etc. A second packing 21 of heat exchange bodies is provided spaced above the water reservoir 19 and also held therein by support means 22. The bottom section 18 or at least that section containing the burner may be of double wall construction as shown at 23 and constituting a cooling water jacket about the burner compartment. A water spray nozzle 24 is also secured spaced above the second packing 21 for spraying water downwardly on the second packing whereby to heat the water by contact with the heat exchange bodies and contact with the hot rising gases and the flame 17'.

A second water reservoir 25 is associated with the top section B and consists of an intermediate wall 26 secured circumferentially with the inner surface of the side wall 11' and provided with a central flue 27 having a cap 28 supported spaced thereabove whereby to permit the rising flow of hot gases from the section A to rise through the water reservoir 25 of section B to heat the water percolating through the packing 13 and sprayed by the spray nozzle 12. The cap 28 prevents percolating water falling by gravity through the top packing 13 from entering into the lower hot section of the burner. The gases rising from the hot section A, depicted by arrows 29, are in the form of hot steam and this steam condenses as it rises through the packing 13 and the cooler (less hot) water spraying from the top spray nozzle 12. This hot steam also condenses and percolates down into the reservoir 25. Accordingly, the water in the lower reservoir 19 is at a much higher temperature than the water in the uppermost reservoir 25 as the single source of heat is generated in the lower section A of the housing and cools as it rises through the lower packing 21 and the upper packing 13 as well as through the water sprayed by the spray nozzles and percolating below the packings. Typically the water being sprayed in the hot section, and namely the lower nozzle 24, may be at a temperature of about 60° C. whereas the water entering in the top section, through nozzle 12 may be at a temperature of about 6° C. The gases exiting the flue 16 is cooled down to a temperature which is below 100° F., achieving highly efficient operation.

As above-described, the water in the hot section 18 and present in reservoir 19 may be used for industrial applications and as hereinshown this hot water is recirculated in a closed circuit 30 through a heat exchange device 31 by a pump 32 connected to the closed circuit 30. The water at the exit 34 of the heat exchange device 31 has cooled by heat exchange with fluid entering the heat exchange device 31 at inlet 33. This cooled hot water at the outlet 34 is connected directly to the water spray nozzle 24 where it is sprayed and heated to a higher temperature as it percolates through the packing and the hot rising gases as well as passing through the flame 17'. As hereinshown the water entering the heat exchange device 31 may be at a temperature of 165° F. and heats up in heat exchange with the water from the hot water reservoir 19 to exit the heat exchange device, at outlet 35, at a temperature of about 185° F.

In the cooler section 14 of the housing 11, water from the reservoir 25 is also pumped through a closed circuit 36 through a heat exchange device 37 and back to the water spray nozzle 12. This water is at a lower temperature and may be used as a heating source for heating domestic water. Typically, the domestic water may be also retained in a holding tank (not shown). The hot water from the reservoir enters the heat exchanger 37 at inlet 38 at a temperature of about 50° F. and will exist at the outlet 39 at a temperature of about 140° F. The hot water in the closed circuit 36 exiting the heat exchange device 37 is directed to the spray nozzle 12 and is typically at a temperature of about 60° F. This cooled water is sufficient to cool the hot gases rising through the packing 13 and this permits the dual section water heater 10 to achieve an efficiency of about 95 percent using a single or multiple burners 17.

Fresh water from the city supply as shown at 25' may also be fed to the spray nozzle 12 by closing the valve 25" and opening valve 26'. Heated water can then be supplied at the outlet conduit 36' by opening the valve 36", and used for industrial or commercial applications.

Figure 2A:
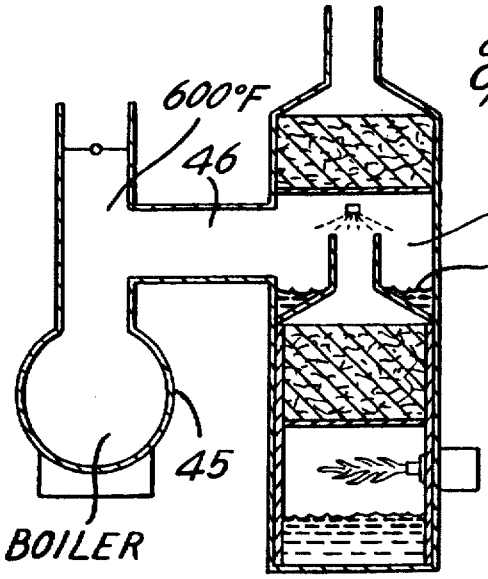
FIGS. 2A and 2B are schematic diagrams showing an external heat source connected to the second and first sections of the dual-section water heater.
Figure 2B:
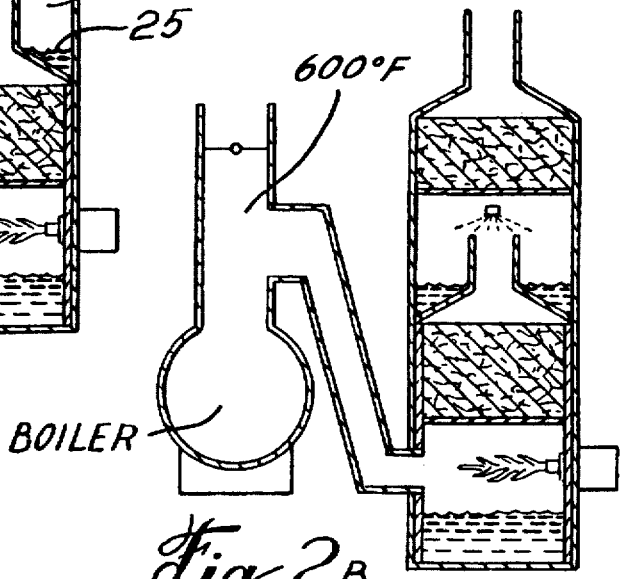
Figure 3:
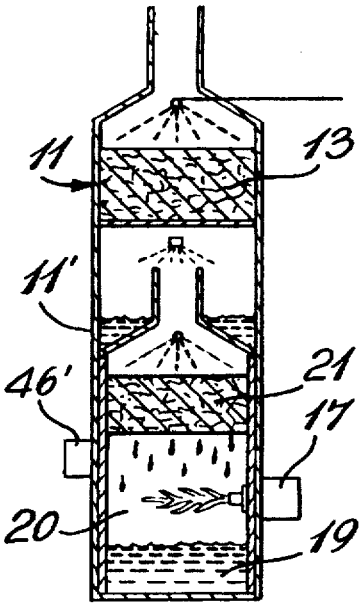
FIG. 3 is a further schematic view showing the hot gases from an external source connected to the first section of the dual section water heater.

As shown in FIGS. 2 and 3, the dual-section direct contact water heater 10 of the present invention may also be connected to a secondary heat source 45, herein a boiler located in a remote area, whereby to recover the hot gases from the boiler, which are normally at temperatures of about 600° F. to feed them back into the dual section water heater. As shown in FIG. 2, a hot recovery gas inlet 46 is connected in the wall 11' of the housing 11 and communicates with the space 47 above the water reservoir 25 and below the packing 13. Typically, the hot gases rising through this space 47 and generated by the burner 17 are at a temperature of about 170° F. and is saturated with water vapor. Accordingly, this secondary source of hot gases will cause the temperature of the water percolating through the packing 13 to rise whereby increasing the temperature of the water in the reservoir 25 of the top section B.

FIG. 3 is a further version of the external hot gases recovery system wherein the gases inlet 46' is herein shown as connected to the side wall 11' of the housing 11 but communicates with the space 20 above the water reservoir 19 in the lower section A.

Figure 4:
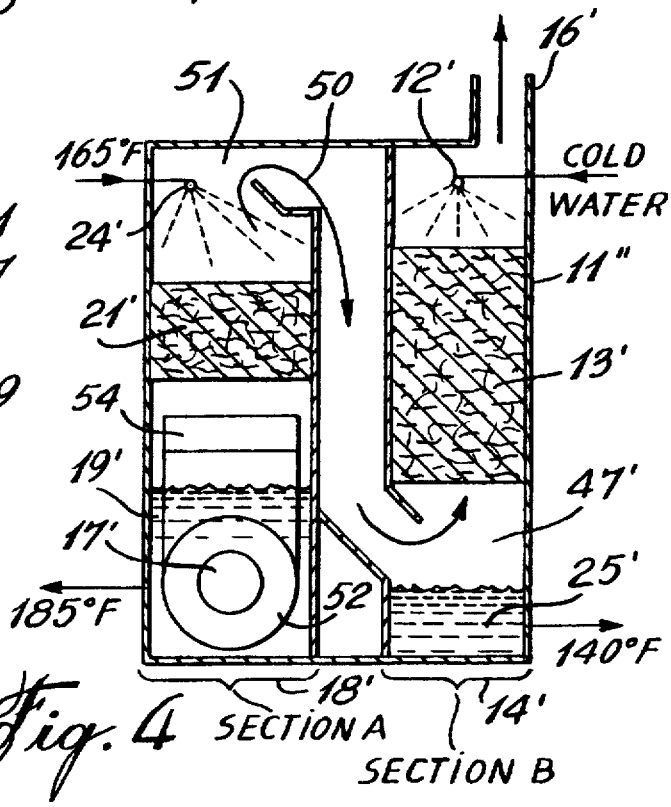
FIG. 4 is a schematic diagram showing a further version of the water heater chamber wherein the sections are located side-by-side to provide a water heater of reduced height.

Referring now to FIG. 4, there is shown a further construction of the direct contact water heater housing 11" of the present invention. As hereinshown the two sections, section 14' and section 18' are disposed side-by-side whereby the housing 11" is reduced considerably in height. This may be desirable depending on the area in which the housing is to be disclosed. As hereinshown the bottom area of the first section 14' defines the water reservoir 25' spaced below its packing 13'. The water spray nozzle 12' is positioned above the packing 13' and below the exhaust flue 16'. A communicating passage 50 is provided between the area 47' above the reservoir 25' and the top end 51 of the second section 18' adjacent the water spray nozzle 24'. The water reservoir 19' of section 18' is located at the bottom of the section 18' and below the packing 21'. As hereinshown, and in order to save space, a burner housing 52 is immersed within the reservoir 19' and submerged at least in part therein. The burner 17", as better shown in FIGS. 5 and 6, generates a flame 53 within the housing 52 to heat the water 53 surrounding the housing 52.

As hereinshown the burner housing 52 is provided with an exhaust port 54 extending above the high water level 53' of the water 53 contained within the reservoir 19' whereby to discharge hot gases, as depicted by arrows 55, from the burner chamber 56.

Figure 5:
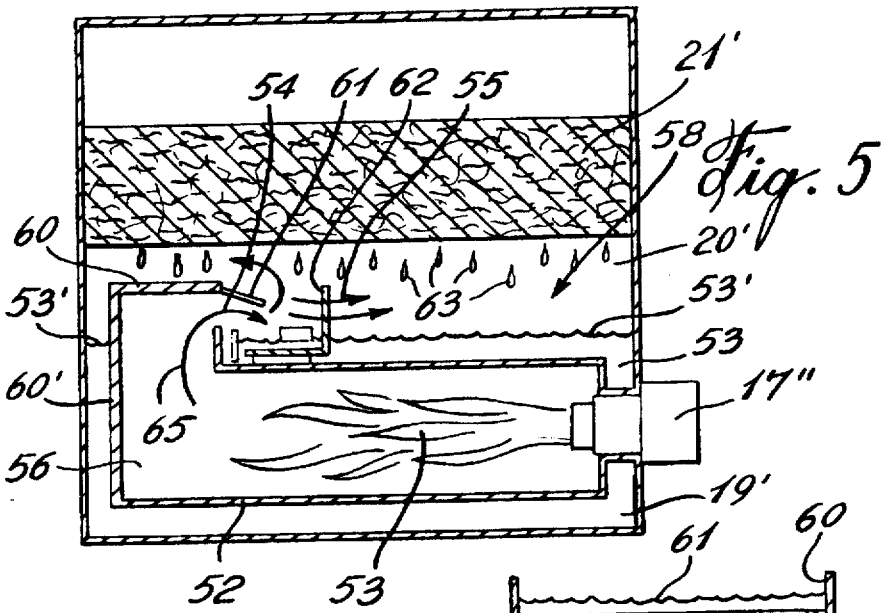
FIG. 5 is a schematic diagram showing an immersed combustion chamber associated with the water reservoir of the first section of the dual-section water heater.
Figure 6:
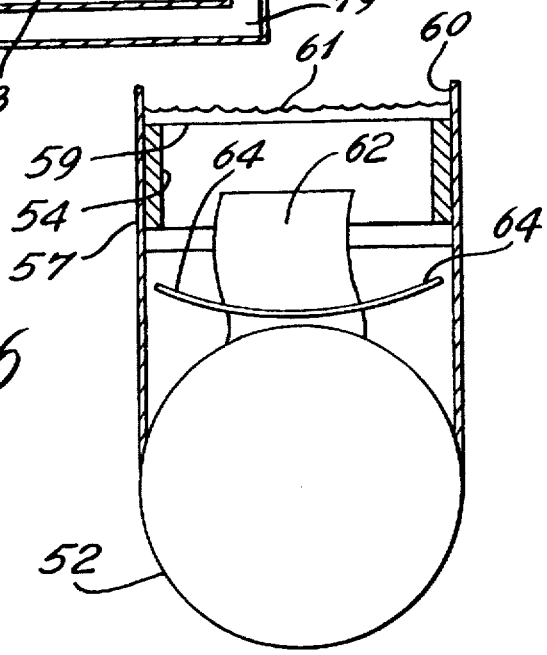
FIG. 6 is a simplified view, like FIG. 5, showing an end view of the combustion chamber.

As better seen from FIGS. 5 and 6, the exhaust port 54 is formed at an end of a vertical flue section 57 of the housing 52 with the exhaust port 54 being disposed as a side opening facing the open area 20' above the water 53 contained within the reservoir 19'. Because the hot gases discharged through the exhaust port 54 are very hot, it is necessary to cool the vertical flue section 57 and deflect the flue gases upwardly towards the percolating water droplets dropping by gravity from the packing 21'. Accordingly, a gas cooling structure is provided.

The gas cooling structure is provided by the vertical flue upper wall 59 defining an open-ended basin 60 on a top portion thereof and extending at 60' around the sidewalls therein whereby to accumulate water droplets 63 percolating down from the packing 21' to cool the top wall 59. Furthermore, deflector plates 61 and 62 are positioned such as to direct the discharging hot gases, as depicted by arrow 55, upwardly towards the second packing to cool these hot gases in heat exchange with the water droplets 63 being discharged from the packing 21'.

As hereinshown, the deflector plate 62 is arcuately shaped and narrower than the exhaust port 54 to deflect the gases upwardly and sidewise. A further deflector plate 64 is provided to each side of the base of the plate 62 to further deflect the hot gases upwardly to the sides. These deflector plates 62 and 64 are secured to the burner housing 52, as shown in FIG. 6. The deflector plate 61 is secured along the top edge of the exhaust port 54 to direct the hot gases, as depicted by arrow 65 against the deflector plate. 62 to disperse the gases, as above described.

The dual direct contact water heater 10 of the present invention was constructed and its thermal efficiency was evaluated as depicted by the following Table showing measurements obtained from sections A and B of the water heater. Typically, section A is the high temperature water generating section and utilizes a gas burner to provide the energy necessary for the production of high temperature water. Section B is used to recover the energy contained in the gases rising from section A and this produces hot water which is sufficient to provide a hot water source to heat city tap water proportional to the energy available in the hot gases and maintain it within the reservoir 25 of section B. The energy available in section B is a function of the temperature of the flue gases.

The following graph gives the results obtained from the test performed on a prototype of a water heater constructed in accordance with the present invention.

TABLE 1

Thermal Efficiency - Dual Direct Contact Water Heater

| | | | | |
|---|---|---|---|---|
| | Section A | | | |
| Water temperature at nozzle (°C.) | 63.3 | 70.0 | 78.8 | 79.8 |
| Burner gas temperature (°C.) | 67.2 | 72.8 | 80.9 | 81.6 |
| Water discharge (nozzle) (gpm) | 260 | 260 | 253 | 256 |
| Power (kW) | 850 | 850 | 850 | 850 |
| Efficiency (%) | 75 | 63 | 47 | 43 |
| | Section B | | | |
| Water temperature at nozzle (°C.) | 1.2 | 1.2 | 1.1 | 1.3 |
| Burner gas temperature (°C.) | 11.2 | 14.8 | 24 | 35.2 |

TABLE 1-continued

Thermal Efficiency - Dual Direct Contact Water Heater

| | | | | |
|---|---|---|---|---|
| Water discharge (nozzle) (gpm) | 25.5 | 29.5 | 32.5 | 29.5 |
| Efficiency (%) | 99 | 96 | 100 | 93 |
| Total Efficiency (%) | 99 | 99 | 99 | 96 |

Note: the air factor is 1.3

Figure 7:
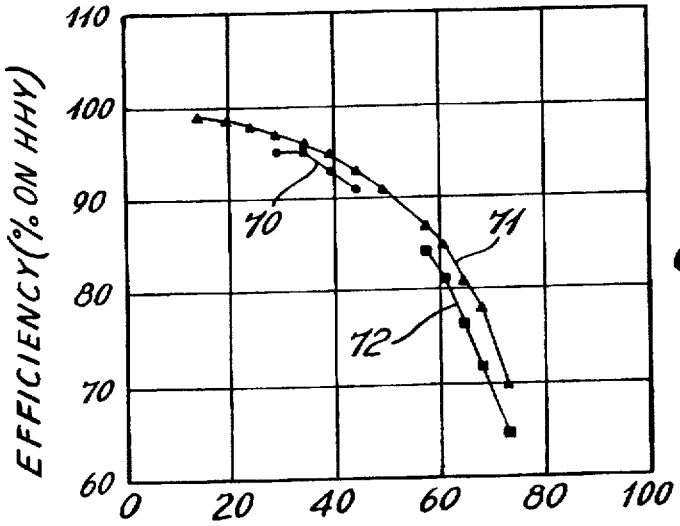
FIG. 7 is a graph illustrating the efficiency of the dual-section water heater of the present invention as compared with a single hot water reservoir direct contact water heater.

Referring now to FIG. 7, there is shown a comparison of the results obtained with the dual section water heater of the present invention as compared to theoretical curves for a single water reservoir direct contact water heater of the prior art. FIG. 7 shows the efficiency curve 70 of the dual water heater of the present invention as compared with a single hot water reservoir direct contact water heater 71. On this graph there is also shown the efficiency curve 72 of the hot section A of the dual burner and it can be observed that the efficiency of this section A, when considered independently, drops rapidly once the temperature of the inlet water, i.e., the water at the spray nozzle 24 is above 60° C. However, the combination with section B permits the hot water heater to increase its efficiency above 90 percent with the parameters as shown in the above Table.

It is further pointed out that the water heater 10, when in a summer mode, does not require high temperature water from the lower section A to heat buildings. Accordingly, the water from the reservoir 19 can be recirculated directly to the spray nozzle 24, through the bypass circuit 30' and valve 41, and the burner 17 is turned down to produce a lower temperature flame. Valve 42 cancels out the heat exchanger 31. The water in section A will still be heated to a high temperature due to the direct feedback bypass circuit 30' to produce hot saturated gases which will rise through section B to provide heat for hot domestic water supply or other processes. The same effect will be achieved by simply shutting off fluid circulation on the secondary side of the heat exchanger 31 (inlet 33 and outlet 35).

It is within the ambit of the present invention to cover any obvious modifications of the preferred embodiment described herein, provided such modifications fall within the scope of the appended claims.

We claim:

1. A direct contact water heater comprising a two-section housing with a first and a second of said sections being disposed side-by-side, a first water spray nozzle secured adjacent a top portion of said first section for spraying water to be heated downwardly on a first packing of heat exchange bodies held in a region of said first housing by support means, a burner connected to a bottom portion of said first housing section and disposed to heat water in a first water reservoir contained within said first housing section, a second packing of heat exchange bodies held in said second housing section spaced above a second water reservoir by further support means, a second water spray nozzle in said second housing section above said second packing for spraying water downwardly on said second packing, a second hot water reservoir defined in said second housing section in a space below said second packing, an exhaust gas flue communicating with a top portion of said second housing section, intermediate communicating passage means for the passage of hot gases from said first packing in said first housing section to a space intermediate said second packing and said second hot water reservoir in said second housing section, and pump means associated with a respective one of said first and second water reservoirs to circulate hot water therefrom to respective external heat exchange devices, connected respectively in a closed circuit, and using said burner.

2. A direct contact water heater as claimed in claim 1 wherein said pump means is a water pump connected between its associated water reservoir and one end of a heat exchange circuit in its associated external heat exchange device, another end of said heat exchange circuit being connected to an associated one of said first or second water spray nozzle whereby said water from said reservoirs is pumped through said heat exchange circuit where it drops in temperature and then sprayed over its associated one of said packings where it is preheated as it percolates down by gravity to its associated reservoir.

3. A direct contact water heater as claimed in claim 2 wherein said water in said first water reservoir is at a higher temperature than said water in said second reservoir, said hot gases passing through said passage means providing a source of hot gas for heating said heat exchange bodies in said second packing and water percolating therethrough, said source of hot gas being cooled by said first packing and first water spray nozzle before it exits through said exhaust gas flue.

4. A direct contact water heater as claimed in claim 3 wherein there is further provided a hot recovery gas inlet in a wall of said first housing section and communicating with a space between said first water reservoir and said first packing to admit a flow of secondary heat in said first housing section and recovered from one or more external heat exhausting devices.

5. A direct contact water heater as claimed in claim 3 wherein there is further provided a hot recovery gas inlet in a wall of said first housing section and communicating with a space below said first packing to admit a flow of secondary hot gases in said chamber and recovered from one or more external devices.

6. A direct contact water heater as claimed in claim 2 wherein hot gas exiting through said exhaust gas flue is at a temperature inferior to 100° F., said external heat exchange device associated with said first water reservoir heating water in heat exchange with hot water from said first reservoir from a temperature of about 165° F. to a temperature of about 185° F., said external heat exchange device associated with said second water reservoir heating water in heat exchange with hot water from said second reservoir from a temperature of about 50° F. to a temperature of about 140° F., said second water spray nozzle providing a water spray at a temperature of about 60° F.

7. A direct contact water heater as claimed in claim 1 wherein said burner is secured to said first housing section adjacent said first water reservoir, a burner housing in said first water reservoir and submerged at least in part therein, said burner generating a flame in said burner housing, said burner housing having an exhaust port extending above a high water level of water contained in said first water reservoir for discharging hot gases from said burner chamber.

* * * * *